United States Patent [19]

Blazek et al.

[11] 4,170,256

[45] Oct. 9, 1979

[54] MOLD ASSEMBLY AND METHOD OF MAKING THE SAME

[75] Inventors: William S. Blazek, Valley City; Thomas S. Piwonka, Solon; James D. Jackson; Philip N. Atanmo, both of Cleveland Heights, all of Ohio

[73] Assignee: TRW Inc., Cleveland, Ohio

[21] Appl. No.: 828,492

[22] Filed: Aug. 29, 1977

Related U.S. Application Data

[63] Continuation-in-part of Ser. No. 653,383, Jan. 29, 1976, Pat. No. 4,066,116.

[51] Int. Cl.[2] ..... B22C 9/04; B22C 9/22

[52] U.S. Cl. ..... 164/26; 164/122; 164/60

[58] Field of Search ..... 164/14, 17, 23, 24, 164/25, 26, 27, 41, 138, 361, DIG. 15, 349, 364, 366, 60, 122, 125

[56] References Cited

U.S. PATENT DOCUMENTS

| | | | |
|---|---|---|---|
| 3,474,851 | 10/1969 | Taylor | 164/23 |
| 3,598,167 | 8/1971 | Snyderman | 164/26 |
| 3,669,177 | 6/1972 | Ingalls | 164/27 X |
| 3,724,531 | 4/1973 | Erickson | 164/60 X |
| 4,063,954 | 12/1977 | Brown | 164/23 X |

*Primary Examiner*—Richard B. Lazarus
*Assistant Examiner*—John S. Brown

[57] ABSTRACT

A segmented mold assembly is utilized to cast a turbine engine component having a relatively heavy hub from which relatively light vanes project. The mold assembly includes a plurality of sections which are formed of a ceramic mold material and are interconnected at flange joints. The mold sections are advantageously formed by repetitively dipping patterns in a slurry of liquid ceramic mold material to form wet coatings on the patterns. These wet coatings are dried and separated from the patterns to form the mold sections. The mold sections which are used to cast the vanes retard the removal of heat from the vanes to provide time for the hub to solidify. This can be accomplished by using relatively thick walled mold sections to form the mold cavities in which vanes are cast and relatively thin walled mold sections to form the cavity in which the hub is cast. This could also be accomplished by forming the vane mold section of material having a relatively low rate of heat removal and the hub mold section of a material having a relatively high rate of heat removal.

8 Claims, 18 Drawing Figures

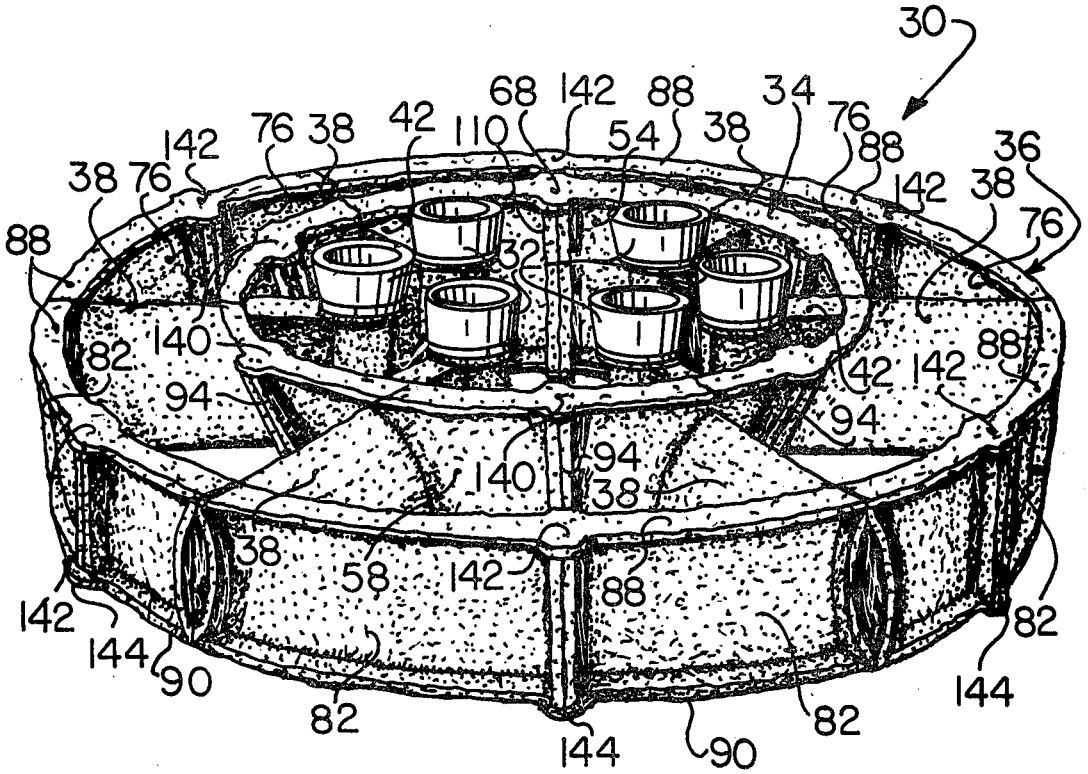
FIG. 2
FIG. 3
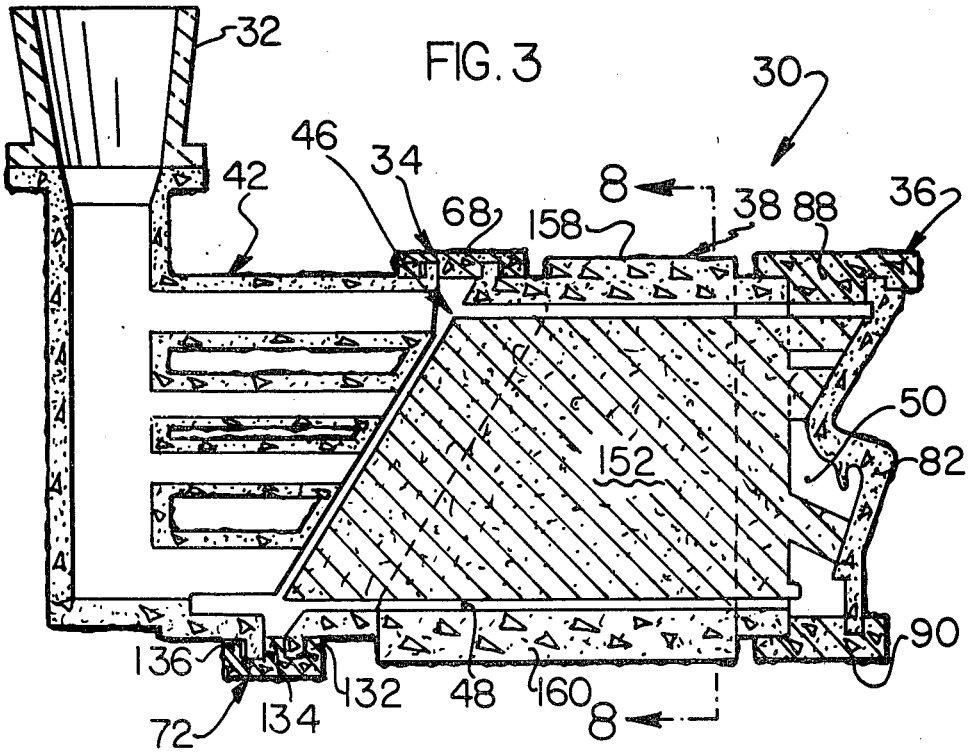

MOLD ASSEMBLY AND METHOD OF MAKING THE SAME

BACKGROUND OF THE INVENTION

This invention is a continuation-in-part of U.S. Blazek et al. application Ser. No. 653,383 filed Jan. 29, 1976 now U.S. Pat. No. 4,066,116.

This invention relates to a new and improved mold assembly and a method by which it is made and more specifically to a segmented ceramic mold assembly which may be advantageously utilized in casting articles having portions of different thicknesses.

When an article having relatively thick and thin portions is to be cast, difficulty may be encountered due to solidification of the relatively thin portion of the article while the relatively thick portion of the article is still molten. This can result in the formation of defects in the thick portion of the article. These defects may be detrimental to the operating characteristics of the article and could result in premature failure of the article under load. For example, turbine engines frequently include a rotatable hub which is integrally cast with radially projecting vanes or airfoils. The hub is relatively thick while the vanes are relatively thin. When the hub and vanes are to be integrally cast, difficulties may be encountered due to solidification of the vanes while the hub is still molten.

SUMMARY OF THE PRESENT INVENTION

The present invention provides an improved method of making an improved mold assembly. The improved method could be utilized to make molds for shaping many different objects. However, the method is advantageously utilized in making a mold assembly which is utilized in the casting of a one piece turbine engine component having portions of different thicknesses.

The mold assembly includes a plurality of interconnected sections. The section of the mold assembly in which a relatively thin portion of an article is to be cast has a lower rate of heat removal than the section of the mold assembly in which a relatively thick portion of the article is to be cast. As is well known, the heat removal rate varies as a function of the thermal conductivity, specific head and density of the mold material.

In one embodiment of the invention the different heat removal rates are obtained by forming the mold assembly with walls of different thicknesses. Relatively thin walled sections are utilized to define a mold cavity in which the thick portion of the article is cast. Thick walled mold sections are utilized to define the mold cavity in which the thin portion of the article is cast. In another embodiment of the invention the composition of the mold sections are different to provide different heat removal rates. The mold wall sections associated with the relatively thick portion of a casting are formed of a substance having a relatively high heat removal rate to promote solidification of the thick portion of the casting.

Accordingly, it is an object of this invention to provide a new and improved mold assembly having thick and thin walled mold sections to provide different heat removal rates from different portions of a casting.

Another object of this invention is to provide a new and improved mold assembly having a section formed of a material with a relatively high rate of heat removal and another section formed of a material having a relatively low rate of heat removal.

BRIEF DESCRIPTION OF THE DRAWINGS

The foregoing and other features of the present invention will become more apparent upon a consideration of the following description taken in connection with the accompanying drawings wherein:

FIG. 2 is an illustration of a mold assembly utilized to cast the jet engine fan frame of FIG. 1 and constructed in accordance with the present invention;

FIG. 3 is a radial sectional view further illustrating the configuration of various sections of the mold assembly of FIG. 2;

DESCRIPTION OF SPECIFIC PREFERRED EMBODIMENTS OF THE INVENTION

Mold Assembly

Figure 1:
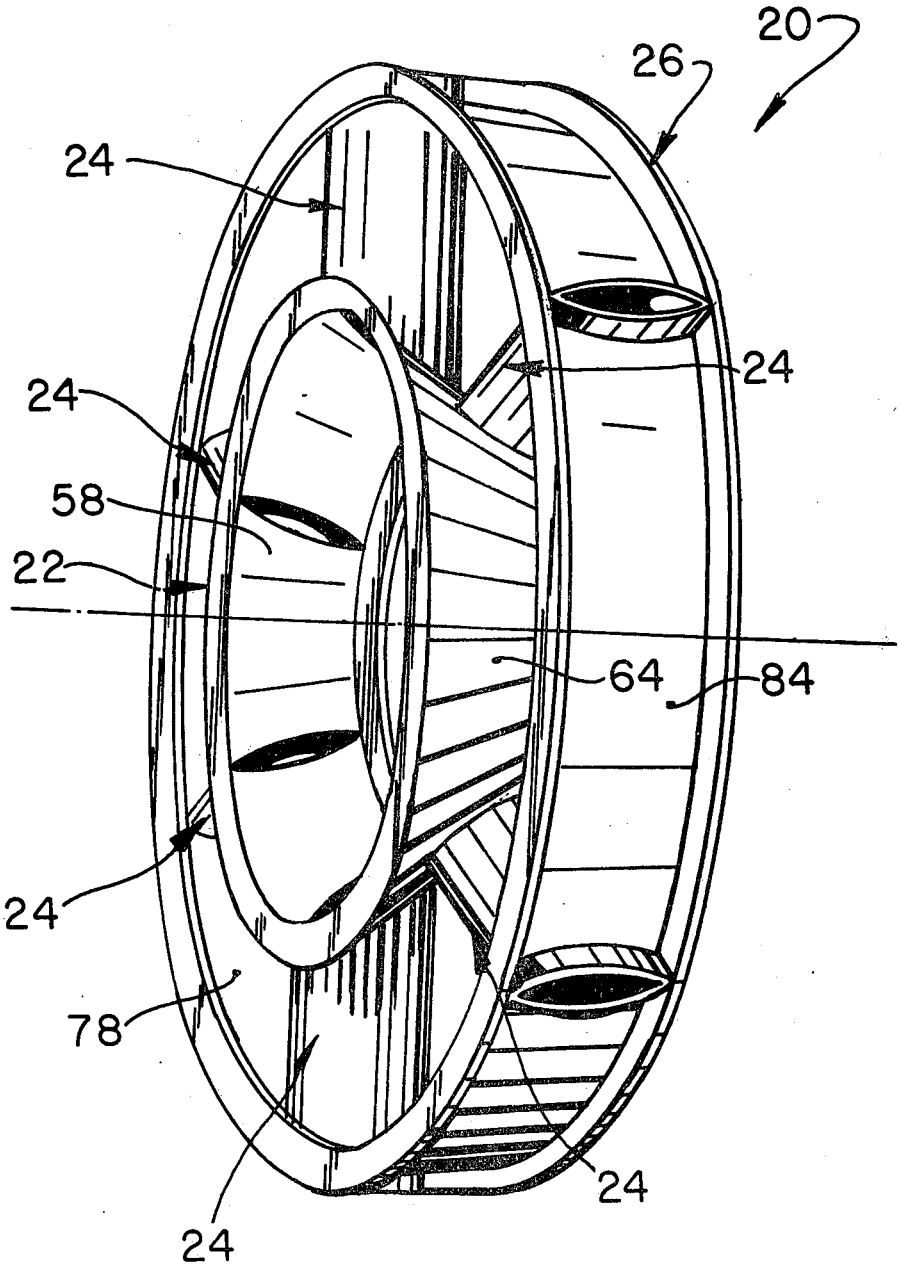
FIG. 1 is an illustration of a cast turbojet engine fan frame.

A fan frame or inlet duct 20 for a turbojet engine is illustrated in FIG. 1. The jet engine fan frame 20 has an annular central hub or wall 22 from which a plurality of struts or vanes 24 extend radially outwardly to a relatively large diameter annular outer ring or wall 26. When the fan frame 20 is installed in a turbojet engine, the inner wall or hub 22 supports one end of the compressor rotor. The struts or vanes 24 direct air flow back to the compressor through the space between the outer ring or wall 26 and hub. The hollow struts 24 are also utilized to enclose conduits and other parts (not shown) leading between the outside of the outer ring 26 and the interior of the hub 22.

Since the outer ring 26 of the jet engine fan frame 20 has a relatively large diameter, that is a diameter in excess of forty inches, and since relatively close dimensional tolerances are required to fabricate a fan frame which will function properly in a jet engine, relatively large fan frames have previously been fabricated by joining a large number of castings, sheet metal details and forgings to form a completed assembly. Although only jet engine fan frame 20 has been illustrated in FIG. 1, it should be understood that the present invention can advantageously be utilized in the forming of other turbine engine components. Among these other turbine engine components are diffuser cases, nozzle rings, vane assemblies and bearing supports.

The jet engine fan frame 20 is cast in one piece in a segmented mold assembly 30 (see FIG. 2). The mold assembly 30 includes a plurality of sprue or pour cups 32 which are disposed within a hub portion 34 of the mold assembly. The hub portion 34 of the mold assembly 30 is connected with an annular outer ring portion 36 of the mold assembly by a plurality of radially extending strut portions 38 of the mold assembly.

As is perhaps best seen in FIG. 3, each of the pour cups 32 is connected in direct fluid communication with the hub portion 34 of the mold assembly 30 by gating 42. The hub portion 34 of the mold assembly 30 is in turn connected in fluid communication with the outer ring 36 of the mold assembly through struts 38. Although the illustrated gating 42 only connects the pour cup 32 with the hub portion 34 of the mold assembly 30, additional gating and/or pour cups could be provided in association with the outer ring portion 36 of the mold assembly if desired. Upon a pouring of molten metal into the pour cups 32 of the mold assembly 30, the metal flows into an annular hub mold cavity 46 (FIG. 3), the radially extending strut mold cavities 48 and into an annular outer ring mold cavity 50. This results in an integrally cast jet engine fan frame 20 having a one-piece construction.

The mold assembly 30 is formed of a plurality of mold sections which are interconnected to define the various mold cavities 46, 48 and 50. Although the jet engine fan frame mold assembly 30 is relatively large, by forming the mold assembly 30 of a plurality of small mold sections, it is possible to accurately form each of the mold sections. These mold sections may then be placed in a jig or locating frame to accurately position them relative to each other and are cemented or otherwise interconnected to form a unitary assembly.

Figure 4:
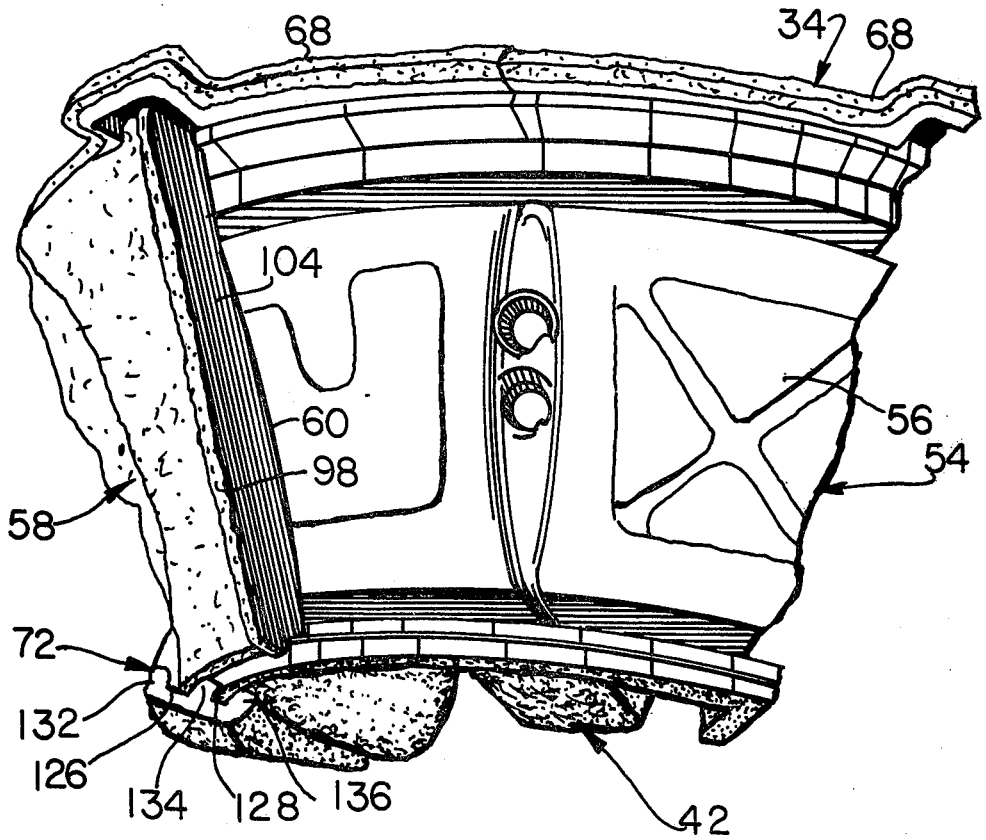
FIG. 4 is a fragmentary upwardly facing view of a hub portion of the mold assembly of FIG. 2 with some of the mold sections removed to further illustrate the segmented construction of the mold assembly.

The various mold sections are constructed in such a manner that the surfaces which define the various mold cavities can be readily inspected prior to construction of the mold assembly 30. Of course, if any defects are noted during the inspection they are either repaired or a properly formed mold section is substituted for the defective mold section. To this end, the hub portion 34 of the mold assembly 30 includes a circular array of hub panel mold sections 54 (see FIG. 4) having major side surfaces 56 with a configuration corresponding to the configuration of portions of an annular inner side surface 58 (see FIG. 1) of the jet engine fan frame hub 22. A second circular array of hub panel mold sections 58 are disposed radially outwardly of the hub mold panel sections 54 (see FIG. 4). The hub panel mold sections 58 have major inner side surfaces 60 of a configuration corresponding to the configuration of portions of the outside surface 64 (see FIG. 1) of the hub 22.

A plurality of top caps or end walls 68 extend between the coaxial circular arrays of hub panel mold sections 54 and 58 to close off the top of the hub mold cavity 46. Similarly, bottom caps or end walls 72 cooperate with the lower edge portions of the hub panel mold sections 54 and 58 to close off the bottom of the hub mold cavity 46 (see FIGS. 3 and 4). The mold sections 54 and 58 may be assembled in an inverted position on a suitable jig or fixture so that the relatively large diameter portion of the hub is disposed downwardly.

The outer ring portion 36 of the mold assembly 30 is constructed in much the same manner as is the hub portion 34 of the mold assembly 30. Thus, the outer ring portion 36 includes a circular array of ring panel mold sections 76 (FIG. 2) having inner surfaces of a configuration corresponding to the configuration of portions of an annular inner side surface 78 (FIG. 1) of the jet engine fan frame 20. A second circular array of ring panel mold sections 82 (FIG. 2) is disposed outwardly of and coaxial with the inner circular array of ring panel mold sections 76. The mold sections 82 have inner or mold surfaces which correspond to the configuration of portions of the annular outer surface 84 (FIG. 1) of the outer ring section 26 of the jet engine fan frame.

The upper and lower end portions of the outer mold sections 76 and 82 are interconnected by end caps or panels 88 and 90 (FIG. 3). The end caps 88 and 90 cooperate with the outer ring panel mold sections 76 and 82 to close the outer ring mold cavity 50 in the same manner as previously described in connection with the hub mold end walls or caps 68 and 72. The circular arrays of outer ring mold sections 76 and 82 circumscribe and are disposed in a coaxial relationship with the circular arrays of hub panel mold sections 54 and 58.

Both the hub portion 34 and outer ring portion 36 of the mold assembly 30 are formed by separate mold sections so that the surfaces which are utilized to form the molten metal in either the annular hub mold cavity 46 or the annular outer ring mold cavity 50 are exposed to view so that they can be inspected. Of course, defective mold sections would be either repaired or replaced. This results in high quality castings which need little or no repair. Since the jet engine fan frame 20 is integrally cast as one piece, the extensive welding and brazing steps currently used to make large jet engine fan frames are unnecessary.

The hub portion 34 and outer ring portion 36 of the illustrated mold assembly 30 are divided into six equal segments so that each of the hub panel sections 54 and 58 and outer ring panel sections 76 and 82 has an arcuate extent of 60°. The circular arrays of hub and outer ring mold sections are concentric with a common axis for the mold assembly 30. Of course, a greater or lesser number of mold sections of different arcuate extents could be utilized if desired.

Figure 6:
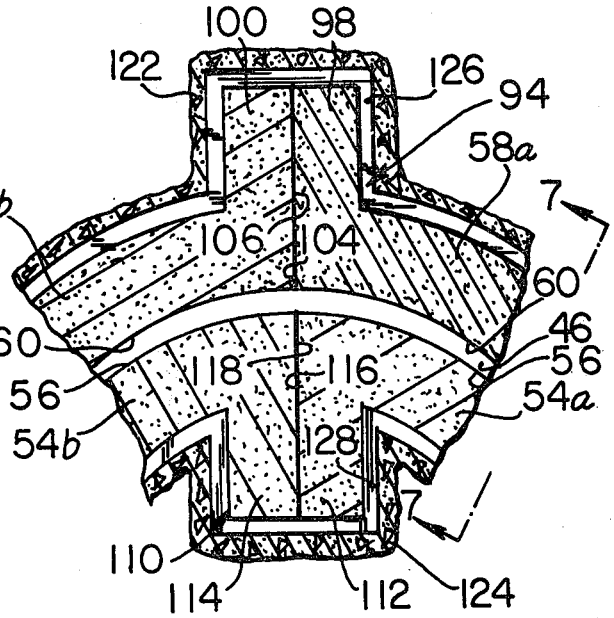
FIG. 6 is a fragmentary sectional view illustrating the manner in which sections of the mold assembly of FIG. 2 are interconnected at flange joints.

The hub and outer ring mold sections 54, 58, 76 and 82 are all interconnected at flange joints formed between circumferentially adjacent mold sections in the manner illustrated in FIG. 6. Thus, a pair of outer hub panel mold sections 58*a* and 58*b* are interconnected at a flange joint 94. The hub mold sections 58*a* and 58*b* have radially outwardly projecting flanges or end sections 98 and 100. The flanges 98 and 100 have flat radially extending joint surfaces 104 and 106 which are disposed in abutting engagement. Due to the tight flat abutting engagement between the surfaces 104 and 106, molten metal cannot leak from the hub mold cavity 46 between the surfaces at the joint 94. The flange sections 98 and 100 are held in tight abutting engagement by a suitable cement (not shown) which is plastered about the outside of the flanges and is formed of a suitable ceramic material.

Similarly, a flange joint 110 is formed between the radially inner hub panel mold sections 54*a* and 54*b*. The hub panel mold sections 54*a* and 54*b* have a pair of radially inwardly projecting flanges 112 and 114. The flanges 112 and 114 have radially extending flat joint surfaces 116 and 118 disposed in abutting engagement with each other.

Although the flange joints between the mold sections 54*a*, 54*b*, 58*a* and 58*b* have been illustrated in FIG. 6, it should be understood that each of the panel sections has a radially projecting flange at each end. Therefore, the six hub panel mold sections 54 forming the radially inner circular array of hub panel mold sections are interconnected at six flange joints of a construction which is the same as the construction of the flange joint 110. The six radially outer hub panel mold sections 58 are each provided with a pair of radially outwardly projecting flanges, one at each circumferential end portion of the mold section, so that six flange joints of the same construction as the flange joint 94 are formed to interconnect the mold sections 58. It should be noted that the major side surfaces 60 on the hub panel mold sections 58 extend generally parallel to the major side surface 56 on the hub panel mold sections 54 to define the circular, relatively thin side wall of the jet engine fan frame hub 22 (see FIG. 1).

Figure 5:
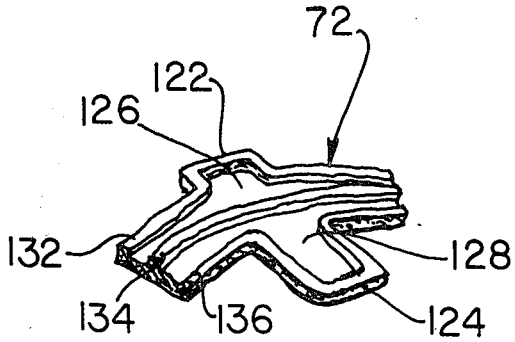
FIG. 5 is an illustration depicting the construction of an end wall utilized in the mold assembly of FIG. 2.

The flange joints 94 and 110 between the hub panel mold sections 58 and 54 are received in radially projecting areas 122 and 124 formed in central portions of the bottom end wall sections 72 (see FIGS. 5 and 6). Thus, the bottom end wall section 72 (FIG. 5) is provided with a pair of major bottom surfaces 126 and 128 which are engaged by the bottom or lower end portions of the hub mold sections 54 and 58. The bottom end wall sections 72 have an angular extent equal to the angular extent of one of the hub mold sections 54 or 58, that is 60° in the illustrated mold assembly. however, the six bottom wall sections 72 are angularly offset relative to the hub panel mold sections 54 and 58 so that the radially projecting portions 122 and 124 are located at the flange joints formed at the ends of the hub mold sections. This results in sealed end joints between adjacent bottom wall sections 72 being disposed midway between the flange joints interconnecting the hub panel mold sections 54 and 58.

Figure 7:
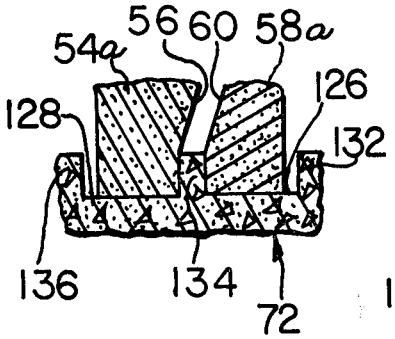
FIG. 7 is a sectional view taken generally along the line 7—7 of FIG. 6 and illustrating the relationship between a pair of mold sections and the end wall of FIG. 5.

The bottom end wall sections 72 advantageously have a generally E-shaped cross sectional configuration (see FIG. 7) to provide for sealing engagement between the end wall 72 and the surfaces of the hub panel mold sections 54 and 58. Thus, the flat bottom surfaces 126 and 128 between the upwardly projecting sides 132, 134 and 136 of the bottom end wall 72 abuttingly engage similarly shaped flat surfaces on the bottom of the hub mold section panels 54*a* and 58*a*. In addition, the lowermost portions of the major side surfaces 56 and 60 of the hub mold sections 54*a* and 58*a* are shaped to abuttingly engage the upwardly projecting side surfaces of the central wall 134 of the bottom end wall 72. The central wall 134 is accurately dimensioned to have a thickness corresponding to the desired distance between major side surfaces 56 and 60 at the bottom wall 72. Leakage of molten metal between the end wall 72 and mold sections 54 and 58 is prevented by sealing or plastering the bottom wall with a suitable ceramic material.

The six top end wall sections 68 for the hub portion 34 of the mold assembly 30 have substantially the same construction as do the six bottom end wall sections 72 (see FIGS. 2 and 3). Thus, each of the top end wall sections 60 is provided with radially projecting portions 140 (FIG. 2) at the top of the flange joints 94 and 110 between the hub panel mold sections 54 and 58. The radially projecting portions 140 cooperate with the top of the flange joints 94 and 110 in the same manner as do the radially projecting portions 122 and 124 of the bottom end wall portions 72.

The outer ring portions 36 of the mold assembly 30 has a construction which is generally similar to the construction of the hub portion 34 of the mold assembly. Thus, the outer ring section 36 includes two concentric circular arrays of six outer ring panel mold sections 76 and 82. Each of these mold sections is provided with a radially extending flange at each circumferentially opposite end of the mold section. The flanges on the outer ring mold sections 76 and 82 have the same construction and cooperate in the same manner as the flanges on the hub mold sections 54 and 58.

A plurality of upper and lower outer ring end wall sections 88 and 90 cooperate with the various mold sections in the same manner as previously described in connection with the hub portion 34 of the mold assembly. It should be noted that there are six upper end wall sections 88 and six lower end wall sections 90 each having the same angular extent, that is 60°, as the associated outer ring panel mold sections 76 and 82. However, the upper and lower end wall sections 88 and 90 are angularly offset relative to the outer ring panel mold sections 76 and 82. However, the upper and lower end wall sections 88 and 90 are angularly offset relative to the outer ring panel mold sections 76 and 82 so that enlarged central portions 142 and 144 on the end wall sections 88 and 90 are disposed at the flange joints interconnecting the outer ring panel mold wall sections.

Figure 8:
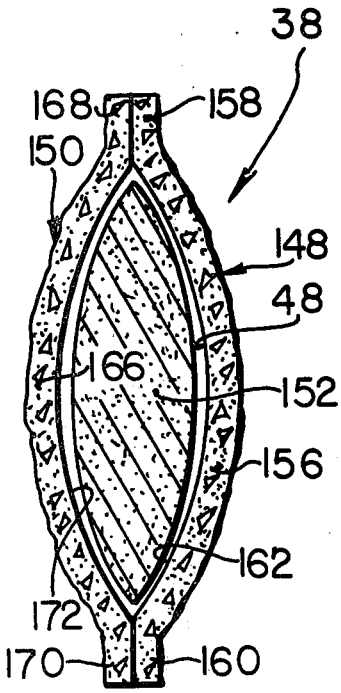
FIG. 8 is a sectional view, taken generally along the line 8—8 of FIG. 3, illustrating the configuration of a strut or vane section of the jet engine fan frame mold assembly.

The strut or vane portions 38 of the mold assembly 30 include a pair of separate mold sections 148 and 150 which cooperate with a core piece 152 to define the strut mold cavity 48 (see FIG. 8). The strut mold section 148 includes an arcuately curving body portion 156 and a pair of outwardly projecting flange portions 158 and 160. The inner surface 162 of the body portion 156 has a configuration corresponding to the configuration of one side of a strut or vane 24 of the jet engine fan frame 20. Similarly, the strut mold section 150 has an arcuate body portion 166 and a pair of outwardly projecting flanges 168 and 170. An arcuate inner surface 172 of the body portion 166 has a configuration corresponding to the configuration of the opposite side of a strut 24 of the jet engine fan frame 20. Although the two sides of the strut have been shown as having the same arcuate configuration, it is contemplated that the struts could be constructed to have different arcuate configurations. Of course, if this was done the inner surface 162 of the strut mold section 148 would have a different curvature than the inner surface 172 of the strut mold section 150.

The flanges 158 and 160 of the strut mold section 148 and the flanges 168 and 170 of the strut mold section 150 have flat inner surfaces which are disposed in abutting sealing engagement to prevent the leakage of molten metal from the strut mold cavity 48. The flanges are held against movement relative to each other by a suitable cement formed of a ceramic mold material. If desired, generally C-shaped caps, similar to the end wall 72, could be utilized in association with the flanges of the mold sections 148 and 150 to further hold them against movement relative to each other.

Method of Making the Mold Assembly

The relatively large jet engine fan frame 20 is integrally formed of a one-piece construction by a precision investment casting or lost wax process. In this process the wax patterns having configurations corresponding to the configurations of the various mold sections are dipped in a slurry of ceramic mold material. After the wax patterns have been repetitively dipped and dried to form a covering of a desired thickness over the wax pattern, the covering and pattern are heated to a temperature sufficient to melt the wax pattern so that the covering over the wax pattern is free of the pattern. The mold could be dewaxed by many other methods including using solvents or microwave energy. At least some of the wet slurry coatings are wiped away from portions of the wax pattern so that the various mold sections can be easily separated when the wax pattern is melted. These mold sections are then assembled in a suitable jig to form the mold assembly 30 of FIG. 2.

Figure 9:
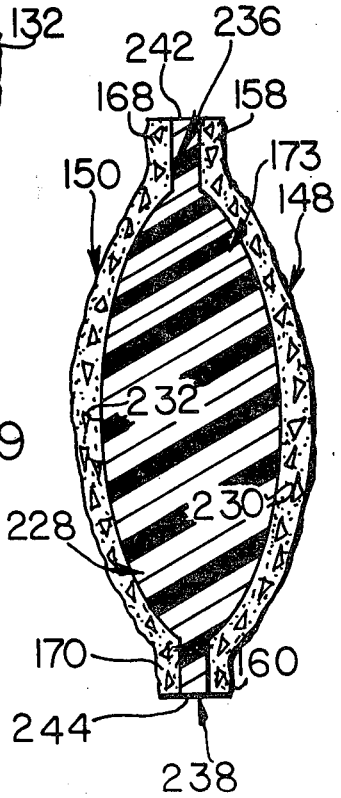
FIG. 9 is a sectional view depicting the relationship between a strut pattern and a covering of ceramic mold material.

A wax pattern 173 (see FIG. 9) is utilized in forming of the strut mold sections 148 and 150. A wax pattern 174 (FIG. 10) is utilized to form the hub panel mold sections 54 and 58 (FIG. 3) and the grating 42. Wax patterns of a configuration similar to the wax pattern 174 (FIG. 10) but without the grating, are utilized in the forming of the outer ring panel mold sections 76 and 82. It should be understood that the disposable patterns could be formed of a material other than wax, for example, a plastic pattern material such as polystyrene could be utilized, if desired.

To form the hub panel mold sections 54 and 58, the wax pattern 174 is repetitively dipped in a liquid slurry of ceramic mold material. Although many different types of slurry could be utilized, one illustrative slurry contains fused silica, zircon, or other refractory materials in combination with binders. Chemical binders such as ethyl silicate, sodium silicate and colloidal silica can be utilized. In addition, the slurry may contain suitable film formers such as alginates to control viscosity and wetting agents to control flow characteristics and pattern wetability.

In accordance with common practices, the initial slurry coating applied to the pattern contains a very finely divided refractory material to produce an accurate surface finish. A typical slurry for a first coat may contain approximately 29 percent colloidal silica suspension in the form of a 20 to 30 percent concentrate. Fused silica of a particle size of 325 mesh or smaller in an amount of 71 percent can be employed, together with less than one-tenth percent by weight of a wetting agent. Generally, the specific gravity of the slurry of ceramic mold material may be on the order of 1.75 to 1.80 and have a viscosity of 40 to 60 seconds when measured with a Number 5 Zahn cup at 75° to 85° F. After the application of the initial coating, the surface is stuccoed with refractory materials having particle sizes on the order of 60 to 200 mesh.

In accordance with well known procedures, each dip coating is dried before subsequent dipping. The pattern is repetitively dipped and dried enough times to build up a covering of ceramic mold material of a desired thickness. In one specific case the pattern was dipped fifteen times to build up a covering of a thickness of approximately 0.400 inches in order to prevent mold bulge. After the dewaxing, mold sections are fired at approximately 1900° F. for one hour to thoroughly cure the mold sections.

To provide the desired mold section configuration, the wax pattern 174 (see FIG. 10) includes a main wall or panel section 176 having an arcuate configuration with an annular extent of sixty degrees. The main wall section 176 includes a radially inner major side surface 178 having a configuration corresponding to the configuration of the radially inner surface 58 (FIG. 1) of the air frame hub 22. A radially outer major side surface 180 of the wal panel 176 has a configuration corresponding to the configuration of the outer surface 64 of the air frame hub 22. It should be noted that a projection 184 is provided on the inner side of the wall 176 to form an opening to an associated strut section. Similarly, a projection (not shown) is formed on the opposite side of the wall 176 to form a root or base to which to connect the strut mold sections.

Figure 10:
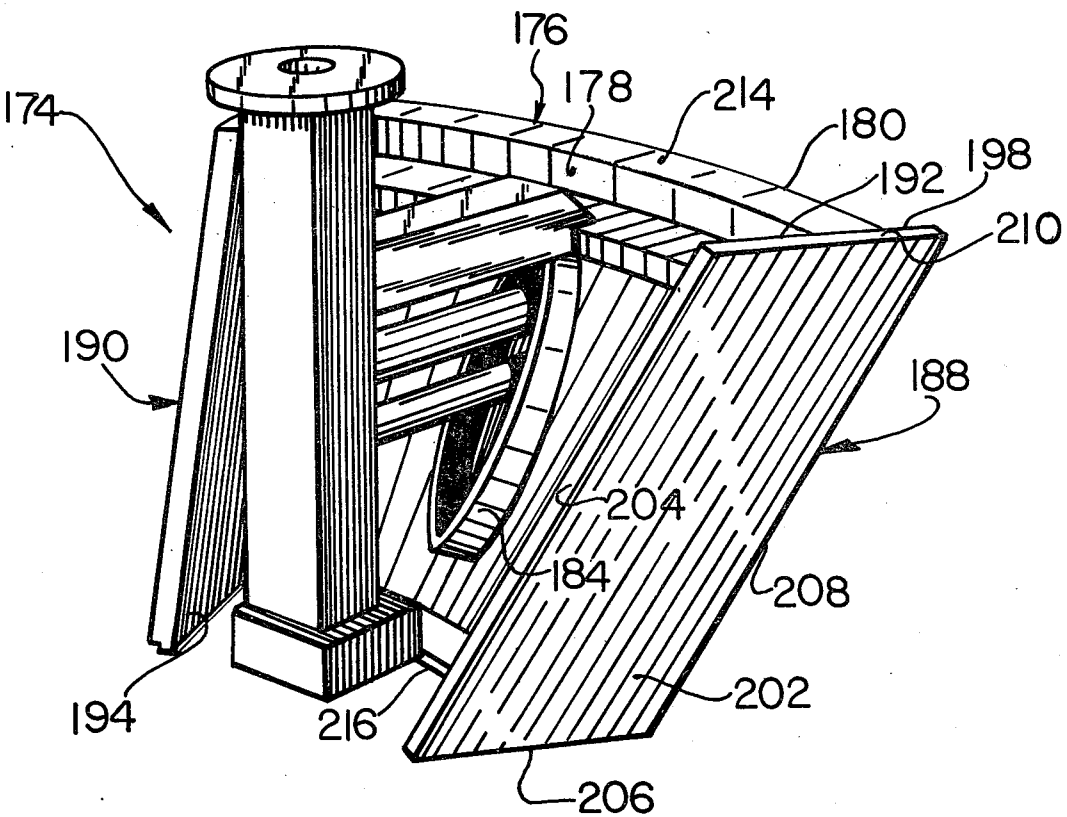
FIG. 10 is an illustration of a pattern utilized in forming hub sections of the mold assembly of FIG. 2.

Since each of the hub panel mold sections 54 and 58 are connected wth adjacent mold sections at flange joints similar to the flange joints 94 and 110 of FIG. 6, pattern flange panels 188 and 190 (FIG. 10) are provided at opposite ends of the main wall 176. The pattern flange panels have inwardly facing side surface areas 192 and 194 which will accurately form the flat flange surfaces 116 and 118 (see FIG. 6) of the hub panel mold sections 54. Similarly, the flange panels 188 and 190 each have a pair of facing side surface areas 198 (only one of which is shown in FIG. 10) which accurately form the flat flange surfaces 104 and 106 (see FIG. 6) on the outer hub panel mold section 58. The flange panel 188 has a flat rectangular major outer side surface 202 which is connected with the major side surface areas 192 and 198 by a plurality of longitudinally extending edge or minor side surfaces 204, 206, 208 and 210. Although the configuration of only the flange panel 188 is fully illustrated in FIG. 10, it should be understood that the flange panel 190 is of the same configuration. It should be noted that the major side surface 202 and the minor side surfaces 204, 206, 208 and 210 of the pattern flange panel 188 do not correspnd to any surfaces on the hub panel mold sections 54 and 58.

Since the major outer side surfaces 202 of the pattern flange patterns 188 and 190 do not correspond to portions of the hub mold sections, the ceramic coating on these outer side panels must be separated from the ceramic coatings on the wall surfaces 178 and 180 and the inner side surface areas 192, 194 and 197 of the flange panels. In addition, the ceramic mold material which was disposed over the inner major side surface 178 of the pattern wall 176 must be separated from the ceramic mold material which was disposed over the outer major side surface 180 of the mold wall 176.

The separating of the hardened ceramic mold material overlying the major outer side surfaces 202 of the pattern flange panels 188 and 190 from the hardened ceramic mold material overlying the major side surfaces 178 and 180 of the panel wall 176 is greatly facilitated by wiping away the wet dip coating on the minor side surfaces of the flange panels immediately after the pattern is dipped in the slurry of ceramic mold material. Similarly, the separating of the hardened ceramic mold material overlying the inner and outer major side surfaces 178 and 180 of the panel wall 176 is facilitated by wiping away the wet coating of ceramic mold material from upper and lower minor edge wall areas 214 and 126 extending between the upper and lower edges of the major side surfaces 178 and 180 of the wall panel 176.

Figure 12:
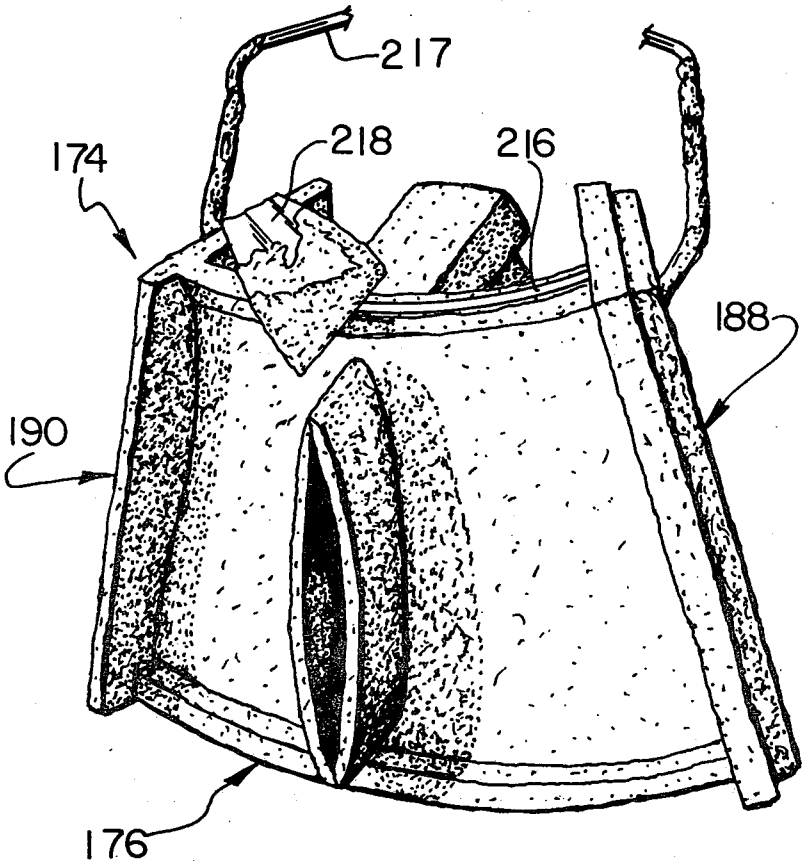
FIG. 12 is an illustration depicting the wiping of a wet coating of ceramic mold material from another surface of the pattern of FIG. 10.
Figure 11:
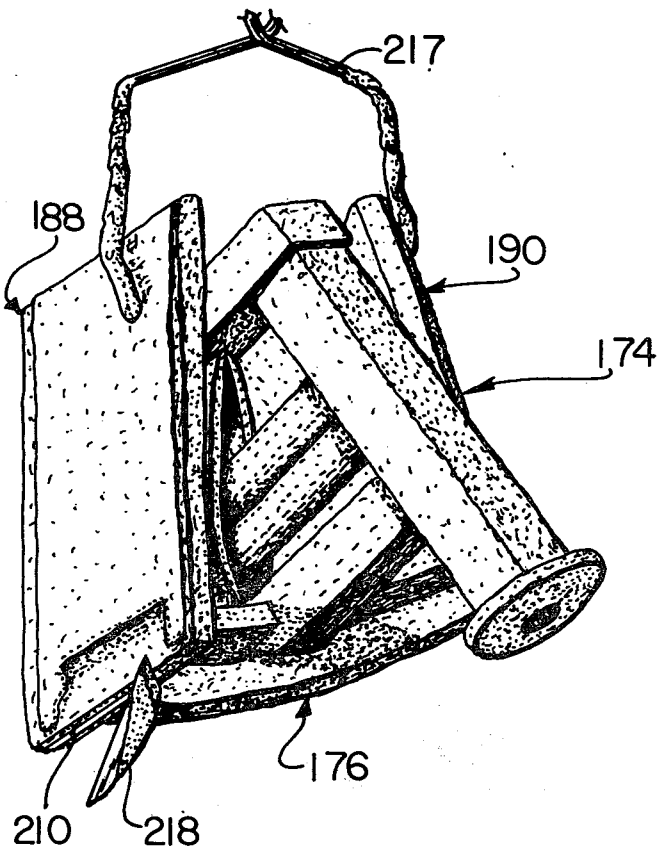
FIG. 11 is an illustration depicting the wiping of a coating of wet ceramic mold material from a surface of the pattern of FIG. 10 which is shown in an inverted position immediately after application of a dip coating to the pattern.

The manner in which the wiping away of the wet coating of ceramic mold material overlying the various minor side or edge surfaces of the pattern 174 is performed is illustrated in FIGS. 11 and 12. After the pattern 174 has been dipped in a liquid slurry of ceramic mold material, the pattern is manually supported above the liquid slurry tank by a support frame 217. A metal blade 218 is utilized to wipe away the slurry coating overlying the edge surface 120 of the pattern flange panel 188 (FIG. 11). Of course, the other minor surfaces 204, 206 and 208 of the pattern flange panel 188 are also wiped with the blade 218 to remove the wet coating of ceramic mold material overlying the surfaces. This separates the portion of the wet coating of ceramic mold material overlying the flange side surface 202 from the wet coating of ceramic mold material overlying the remainder of the pattern 174. The wet coating of ceramic material is then wiped from the minor sides of the pattern flange panel 190. This separates the portion of the coating of wet ceramic mold material overlying the major side surface of the flange 190 from the wet coating of ceramic mold material overlying the rest of the pattern 174.

The portions of the coating of wet ceramic mold material overlying the major side surfaces 178 and 190 are separated from each other. To this end, the wet coating of ceramic mold material overlying the minor side edge surface 126 is wiped away in the manner illustrated in FIG. 12. Finally, the top edge surface 124 of the pattern 173 is wiped with the blade 218 to complete the removal of the wet coating of ceramic mold material from the connecting surfaces of the pattern 174.

It should be noted that the foregoing wiping steps separated the wet coating of mold ceramic material overlying the pattern 174 into a plurality of discrete segments each of whcih is separated from an adjacent segment by a wiped area. In the illustrated embodiment of the invention two of the segments of wet dip coating correspond to two mold sections. Thus, the segment of wet dip coating overlying the inner major side surface 178 of the pattern corresponds to a hub mold section 54 and the segment of the wet dip coating overlying the major outer side surface 180 of the pattern wall 176 corresponds to the hub mold section 58. The segments of wet dip coating overlying the major outer side surfaces of the pattern flange pannels 188 and 190 do not correspond to any of the mold sections.

As the pattern 174 is repetitively dipped, each wet coating is wiped in the manner previously explained and then dried. This results in the formation of a multi-layered covering of ceramic mold material on the pattern. This covering of ceramic mold material is sharply discontinuous at the areas overlying the wiped surfaces of the pattern. Thus the wiped minor flange surface 204 of the pattern flange panel 188 (see FIG. 13), a covering 218 of ceramic mold material overlying the flange panel side surface 202 is separated from a covering 220 overlying the inner side surface 198 of the inner flange panel 188 and the major surface 178 of the pattern wall 176. When the wax pattern is disposed of by melting, the dried covering 128 of ceramic mold material overlying the pattern flange panel surface 202 is separated from the dried covering 220 of ceramic mold material overlying the pattern flange panel surface 198 and side wall surface 178. Similarly, a covering 224 of dried ceramic mold material overlying the pattern flange surface 198 and the outer pattern wall surface 180 is separated from the covering 128 overlying the major outer surface 202 of the pattern flange panel.

Figure 13:
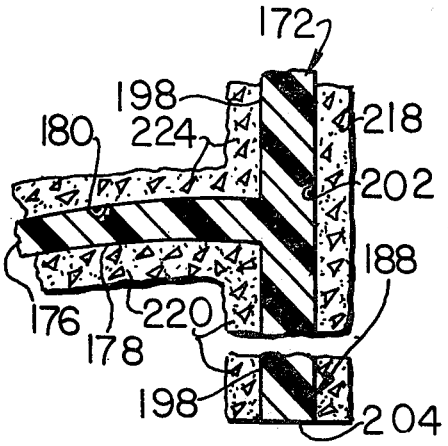
FIG. 13 is a fragmentary sectional view illustrating the relationship between a covering ceramic mold material on the pattern of FIG. 10 and a wiped surface.

If the wiping steps had not been performed, the covering of ceramic mold material would have completely enclosed the pattern and would not have been discontinuous in the manner illustrated in FIG. 13. Therefore, when the pattern was subsequently melted and the ceramic mold material fired, all of the sections of the ceramic mold material would be firmly interconnected and the hardened covering would have to be cut or abraded away in a troublesome and time consuming manner. By performing the wiping steps, the troublesome and time consuming cutting or abrading away of the hardened ceramic mold material is eliminated with consequent savings in the cost of producing the mold assembly 30.

All of the coatings of wet ceramic mold material can be wiped away from the parting or separating surfaces of the pattern to expose the pattern surface in the wiped away areas as illustrated in FIG. 13. However, it has been found to be advantageous to omit the wiping step after the intial dip coating of ceramic material is applied to the pattern. This initial dip coating of ceramic mold material is very fine and, after drying, forms a barrier to seal and protect the corners of the pattern during subsequent dip coatings and wipings. It should be understood that although the wiping step is advantageously omitted after the initial coating is applied to the pattern, the wiping step is performed after each of the subsequent dip coatings. Thus, after the initial dip coating has been dried and the pattern is dipped for a second time, the wet coating of ceramic mold material overlying the various edges of minor surfaces of the pattern is wiped away in the manner illustrated in FIGS. 11 and 12. When the pattern is subsequently melted and the ceramic mold material fired, an extremely thin delicate shell resulting from the initial dip coating extends between the built up relatively heavy sections of ceramic mold material. This thin connecting coating is easily broken to separate the various mold sections and does not require a time consuming cutting or abrading operation. It should be noted that the initial dip coating of ceramic mold material is not stuccoed and is very fine so that it can be readily broken.

It should be understood that the flat flange joint surfaces 104, 106, 116 and 118 (see FIG. 6) are accurately formed by side surfaces 192, 194 and 198 (FIG. 10) of the pattern flanges 188 and 190. By accurately forming the flat flange joint surfaces 104, 106, 116 and 118, a fluid tight seal can be readily obtained at the various flange joints.

The strut mold pattern 173 (FIG. 9) is dipped in a slurry of ceramic material and wiped in the same manner as previously explained in conjunction with the hub mold pattern 174. The strut mold pattern 173 has a body 228 with a pair of arcuate outer side surfaces 230 and 232. The outer side surface 230 of th strut pattern 173 has the same configuration as one of the side surfaces of a jet engine fan frame strut 24. The opposite side surface 232 of a pattern body 228 has a configuration corresponding to the configuration of the opposite side of a strut 24.

Although the two side surfaces 230 and 232 of the strut pattern body 228 have configurations corresponding to the configuration of opposite sides of a strut 24, the two side surfaces 230 and 232 of the pattern body 228 are spaced further apart than are the opposite side surfaces of a strut. The spacing between the opposite side surfaces 230 and 232 of the pattern body 228 exceeds the spacing between the opposite side surfaces of the strut 24 by the thickness of a pair of flange sections 236 and 238 which extend outwardly from the pattern body 228. The flange sections 236 and 238 accurately form flat surfaces on the flange portion 158, 160, 168 and 170 of the mold sections 148 and 150. When the pattern 173 is disposed of by melting, the separate strut mold sections 148 and 150 can be connected together with the flange surfaces in abutting engagement in the manner illustrated in FIG. 8. When the mold sections are interconnected in this manner, the inner side surfaces 162 and 172 of the mold sections 148 and 150 are spaced apart by a distance which is equal to the spacing between the opposite sides of the strut 24.

During the forming of the strut mold sections 148 and 150, the longitudinally extending minor edge surfaces 242 and 244 of the flanges 236 and 238 are wiped to remove the portion of the wet coating of ceramic mold material overlying these surfaces. This results in the coating of wet ceramic mold material being divided into two segments, that is the segment overlying the outer side surface 230 of the strut pattern body 228 and the segment overlying the ouer side surface 232 of the strut pattern body. Although in the illustration in FIG. 9 each of the wet dip coatings of ceramic mold material was wiped from the flange surfaces 242 and 244 to expose these surfaces, it it belived to be advantageous to omit the wiping of the initial dip coating so that a protective shell is formed over the outer flange surfaces after the initial dip coating has been dried and prior to wiping of the subsequent coatings.

Although only the strut pattern 173 and hub section pattern 174 have been illustrated in the drawings, it should be understood that outer ring section patterns and end wall patterns are also utilized. The outer ring section patterns have a main wall section with an outer surface corresponding to the configuration of the outer side surface 84 (FIG. 1) of the outer ring 26 of the jet engine fan frame 20 and an inner side surface corresponding to the configuration of the inner side surface 78 of the outer ring of the jet engine fan frame. Since the mold sections 76 and 82 for the outer ring portion 36 of the mold assembly 30 are interconnected at flange joints (see FIG. 2) in the same manner as are the hub mold sections, the patterns for the outer ring sections are provided with flange panels similar to the flange panels 188 and 190 utilized in association with the hub pattern. Of course, the minor side or outer edge surfaces of the outer ring patterns are wiped in the same manner as previously explained in connection with the hub patterns.

Figure 14:
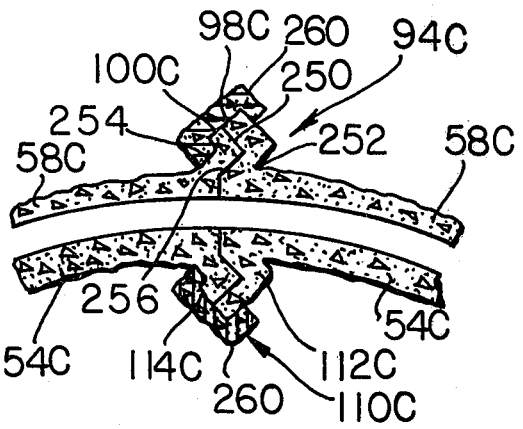
FIG. 14 is a fragmentary sectional view illustrating the construction of generally Z-shaped joints utilized in connecting mold sections of a second embodiment of the invention.
Figure 15:
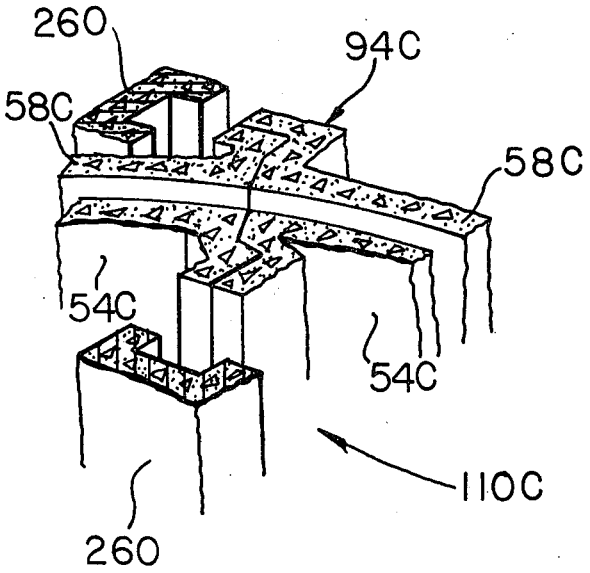
FIG. 15 is a fragmentary illustration depicting the relationship between the Z-type flange joints of FIG. 14 and cap members which are utilized to hold the mold sections against movement.

In the embodiment of the invention illustrated in FIGS. 1–13 the flange surfaces between the various mold sections are flat so that the mold sections must be positioned relative to each other by suitable locating pins on a jig. However, in the embodiment of the invention illustrated in FIGS. 14 and 15 the flange surfaces are not flat and are utilized to position the adjacent mold sections relative to each other. Since the embodiment of the invention illustrated in FIGS. 14 and 15 is generally similar to the embodiment illustrated in FIGS. 1–13, similar numerals will be utilized to designate similar components with the suffix "c" added to the numerals in the embodiment of the invention illustrated in FIGS. 14 and 15 to avoid confusion.

Flange joints **94*c* and 110*c* between mold sections 58*c* and 54*c* (see FIG. 14) are formed by flanges 98*c*, 100*c*, 112*c* and 114*c* projecting radially out from the main walls of the mold sections. Each of the flanges has an accurately formed generally Z-shaped surface. Thus, the flange 98*c* has a surface 250 which extends at an angle to the surface 252 of the flange. Similarly, the flange 100*c* has a surface 254 which extends at an angle to a second flange 256. The angular intersection between the flange surfaces 250 and 252 cooperates with the angular intersection between the flange surfaces 254 and 256 to position the adjacent mold sections 58*c* relative to each other. An end cap 260 is advantageously utilized to hold the flange surfaces in tight abutting engagement. It is believed that it will be apparent that the flange joint 110*c* has the same construction as the flange joint 94*c* and is effective to position the adjacent mold sections 54*c*** relative to each other. In addition to locating the adjacent mold sections relative to each other, the generally Z-shaped flange surfaces may be preferred under certain circumstances due to the sealing action obtained by the irregularly shaped joint.

Mold Assembly With Different Heat Removal Rates

Figure 16:
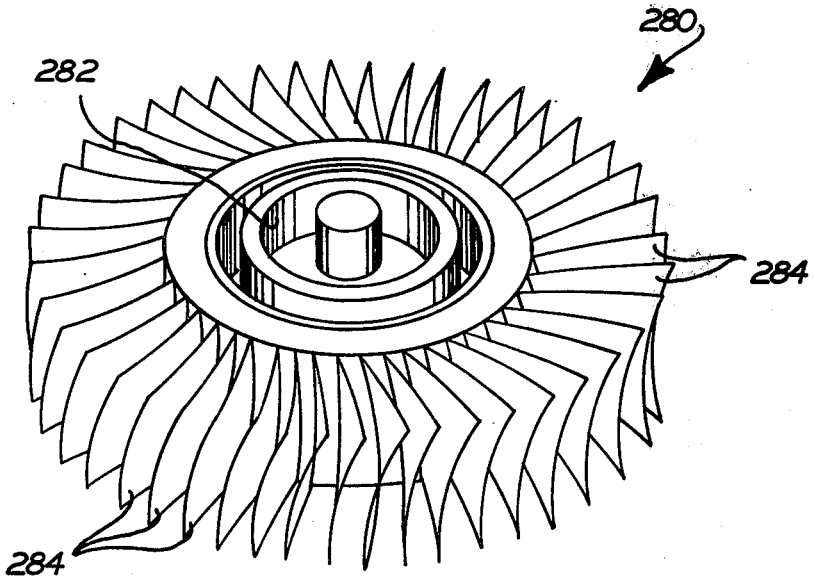
FIG. 16 is an illustration of a turbine engine component having a relatively thick hub section and relatively thin vane sections.

A turbine engine component 280 having a relatively thick hub portion 282 from which relatively thin vanes or airfoils 284 extend radially is illustrated in FIG. 16. The hub 282 and vanes 284 are integrally cast as one piece. During the casting process, the relatively thin vanes 284 tend to solidify before the relatively thick hub 282 solidifies. If the hub 282 is allowed to remain molten after the vanes have solidified, defects may be formed in the hub. Of course, any defects which are formed in the hub 282 are detrimental to its strength. Although many different types of defects could develop with different metals, microporosity and inclusions are the most common defects to be eliminated. In addition, controlling the heat removal rate enables grain structure and size to be controlled.

Although the turbine engine component 280 has been illustrated in FIG. 16 as having vanes 284 which are not associated with an outer ring or shroud similar to the outer ring 26 of the turbine engine component 20 of FIG. 1, it is contemplated that such an outer ring could be associated with the turbine engine component 280. If this were done, the outer ring could solidify after the vanes 284 solidify and before the hub 282 solidifies with the formation of defects in both the hub and outer ring.

Figure 17:
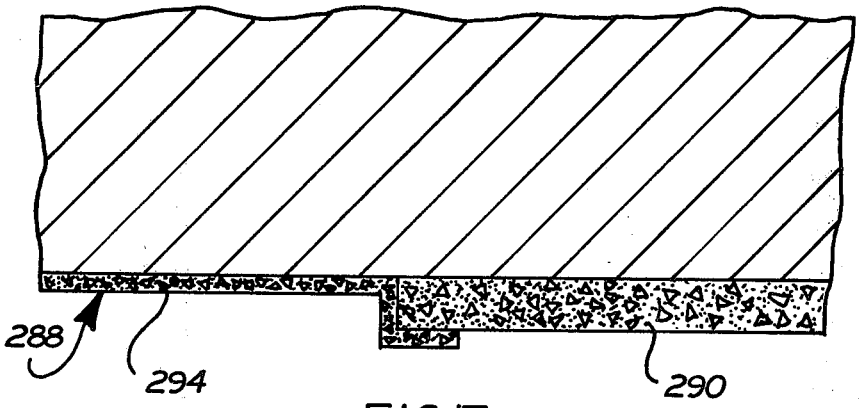
FIG. 17 is a fragmentary sectional view of a portion of a mold assembly having thick and thin walled mold sections.

In accordance with a feature of the present invention, the turbine engine component 280 is cast in a mold assembly 288, a portion of which is shown in FIG. 17. The mold assembly 288 is formed of a plurality sections which are interconnected to define relatively small cavities in which the vanes 284 are cast and a relatively large cavity in which the hub 282 is cast. The various sections are interconnected in the same manner as previously explained in connection with the mold assembly 30.

The mold assembly 288 includes sections having different heat removal rates. Thus, a mold section 290 in which a vane or airfoil 284 is cast has a relatively low rate of heat removal while a mold section 294 in which the hub 282 is cast has a high rate of heat removal. The different rates of heat removal result in a promoting of solidification of the relatively thick hub 282 and retarding of solidification of the relatively thin vanes 284. This tends to minimize any tendency for defects to form in the hub as it solidifies.

It is contemplated that the different heat removal rates for the mold sections 290 and 294 could be obtained in several different ways. In the embodiment of the invention illustrated in FIG. 17, the vane mold section 290 has a relatively thick wall to retard removal of heat from the relatively thin vanes or airfoils 284. The hub mold section 294 has a relatively thin wall to enable heat to be readily removaved from the relatively thick hub 282.

The different mold wall thicknesses are obtained by dipping the associated patterns a different number of times in a slurry of liquid ceramic mold material. Thus, a wax or plastic pattern having a configuration corresponding the shape of a single vane 284 is dipped in a liquid ceramic mold material a relatively large number of times, for example twelve times, to form a relatively thick build-up of ceramic mold material over the pattern. Each time the vane pattern is dipped, it is wiped in the manner previously explained to remove the wet ceramic mold material from an area where a joint is to be formed between the mold sections 290 and 294. The relatively thick wall of the vane mold section 290 has a relatively low rate of heat removal and tends to maintain the vane molten while the hub is solidifying.

To promote the solidification of the hub, the mold section 294 has a relatively thin wall. The relatively thin walled mold section 294 was obtained by dipping a hub pattern a relatively small number of times in liquid ceramic mold material. For example, the hub pattern associated with the mold section 294 was dipped only six times to provide a relatively thin build-up of ceramic mold material. The thin walled hub mold section 294 and a plurality of thick walled vane mold sections 290 are interconnected in the manner previously explained to form a mold assembly in which the turbine engine component 280 is cast.

The thin walled hub mold section is not as effective to insulate the hub as the relatively thick walled vane mold sections 290. Therefore, the heat transfer rate from the hub is greater than the heat transfer rate from the vanes to promote solidification of the hub contemporaneously with solidification of the vanes. The transfer of heat from the hub can be further promoted by investing the mold 288 in a container with steel shot adjacent to the hub mold section 294 to provide a heat sink.

Figure 18:
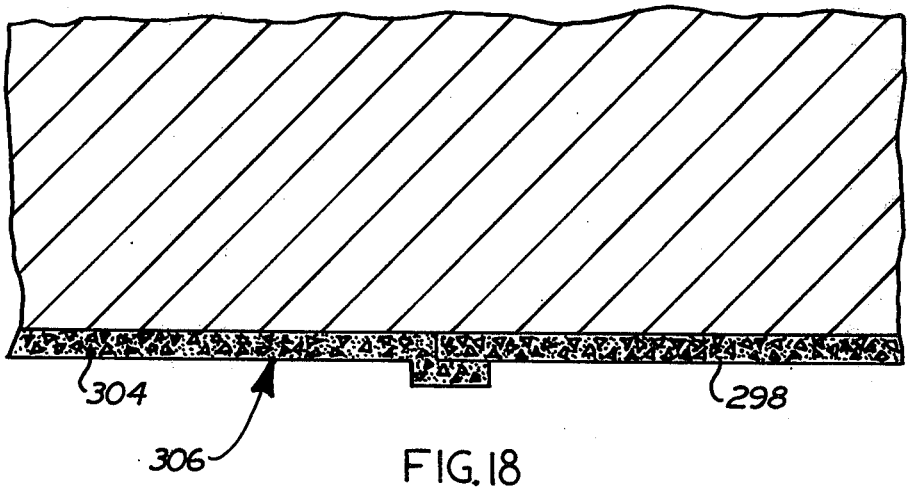
FIG. 18 is a fragmentary sectional view of a portion of a mold assembly having sections with walls of different compositions.

It is also contemplated that the mold sections could be provided with different heat removal rates by forming the mold sections of different materials. Thus, the pattern for a vane mold section 298 (FIG. 18) is dipped in a slurry of colloidal silica in which Zircon is suspended. The resulting wet covering of ceramic mold material is coated with a stuccoing of fused silica having a particle size on the order of 60 to 20 mesh This wet coating is then dried. After repetitive dipping, stuccoing and drying, the resulting covering is separated from the pattern to form a ceramic mold section in the manner previously explained.

A hub mold section 304 is formed by dipping a pattern having a configuration corresponding the configuration of the hub 282 in a slurry of colloidal silica having the same composition as the slurry in which the vane pattern was dipped. However, the wet covering of ceramic mold material on the hub pattern is stuccoed with zircon. The wet covering of silica stuccoed with zircon is then dried. After repetitive dipping, stuccoing and drying, the resulting covering is separated from the pattern. Due to the zircon stuccoing, the resulting hub mold section has a heat removal rate which is greater than the heat removal rate of the vane mold section 298 formed by coating a wet slurry covering of silica with a stuccoing of fused silica. Of course, other stuccoing materials having a relatively high heat removal rate could be utilized if desired.

The two mold sections 298 and 304 are interconnected at joints in the matter previously explained in connection with the mold assembly 30. This results in a mold assembly 306 having a hub mold section 304 with a relatively high heat removal rate and a vane mold section 298 with a relatively low heat removal rate. Although the mold sections 298 and 304 have the same thickness, it is contemplated that they could be formed with different thicknesses by coating the associated patterns different numbers of times with ceramic slurry and stucco.

It is contemplated that it may be desirable under certain circumstances to form both of the mold sections of completely different materials. This could be done by repetitively dipping the hub pattern in a slurry of ceramic mold material having a high heat removal rate. The vane pattern would be repetitively dipped in a slurry of a different ceramic mold material having a low heat removal rate. For example, a pattern associated with a thick portion of an article could be dipped in a slurry having a zircon filler while the other pattern is dipped in a slurry having a fused silica filler.

Another way of controlling the heat removal rate of the mold sections is to form the mold sections with different porosities. The vane mold section would be made relatively porous to retard heat removal. The hub mold section would be relatively dense to promote heat removal.

In view of the foregoing, it is apparent that the present invention provides an improved method of making a mold assembly having portions with different heat removal rates. The mold assembly includes a plurality of interconnected sections. The sections of the mold assembly in which relatively thin portions of the article are to be cast have a lower rate of heat removal than the sections of the mold assembly in which relatively thick portions of the articles are to be cast. Of course if desired, the mold could be constructed to have a high heat removal rate from the thin portion of the casting and a low heat removal rate from the thick portion of the casting.

In one embodiment of the invention the different heat removal rates are obtained by forming the mold assembly 288 with walls of different thicknesses. A relatively thin walled section 294 is utilized to define a mold in which the thick hub portion of the article is cast. Thick walled mold sections 290 are utilized to define the mold cavities in which the thin vane portions of the article are cast. In another embodiment of the invention the composition of the mold sections are different to provide different heat removal rates. The mold wall section 304 associated with the relatively thick hub portion of a casting is formed of a substance having a relatively high heat removal rate to promote solidification of the hub portion of the casting. The vane mold sections 298 are formed of a material having a relatively low heat removal rate to retard solidification of the vanes.

Having described specific preferred embodiments of the invention, the following is claimed:

1. A method of making a mold assembly having portions of different thicknesses and different heat transfer rates, said method comprising the steps of providing a plurality of separate disposable patterns each of which has a surface area with a configuration similar to a portion of a surface area of a product, at least partially coating each of the disposable patterns with a wet covering of ceramic mold material while maintaining the patterns separate from each other, drying the wet covering on the separate patterns, repeating the coating and drying steps with a first one of the plurality of patterns a first number of times to build up a relatively thick covering of ceramic mold material on the first pattern, repeating the coating and drying steps with a second one of the plurality of patterns a second number of times which is less than the first number of times to build up a relatively thin covering of ceramic mold material which is disposed on the second pattern and is separate from the relatively thick covering on the first pattern, separating the relatively thick covering of ceramic mold material from the first pattern to provide a relatively thick walled mold section having a first heat transfer rate, separating the relatively thin covering of ceramic mold material from the second pattern to provide a relatively thin walled mold section which is separate from the relatively thick walled mold section and has a second heat transfer rate which is greater than the first heat transfer rate, and interconnecting the relatively thick and thin walled mold sections to at least partially form the mold assembly.

2. A method as set forth in claim 1 wherein said steps of coating the first one of the plurality of patterns includes the step of dipping the first pattern in a body of liquid ceramic mold material having a first composition, said steps of coating the second one of the plurality of patterns including the step of dipping the second pattern in a body of liquid ceramic mold material having a second composition which is different than said first composition and which has a heat transfer rate which is different than the heat transfer rate of the first composition.

3. A method as set forth in claim 1 wherein said steps of coating the first pattern includes covering at least a portion of the first pattern with a ceramic mold material having a first rate of heat removal when the mold material has dried, said steps of coating the second pattern includes covering at least a portion the second pattern with a ceramic mold material having a second rate of heat removal when the mold material has dried, the second rate of heat removal being greater than the first rate of heat removal to promote a removal of heat through the thin walled mold section.

4. A method as set forth in claim 1 wherein said steps of coating the first pattern includes dipping the first pattern in a body of liquid ceramic mold material to form a wet coating on the first pattern and stuccoing the wet coating with a first material, said steps of coating the second pattern including dipping the second pattern in a body of liquid ceramic mold material to form a wet coating on the second pattern and stuccoing the wet coating with a second material which is different than the first material to effect the formation of coverings having different characteristics over the first and second patterns.

5. A method of forming a mold assembly comprising the steps of providing a plurality of separate disposable patterns each of which has a surface area with a configuration similar to a portion of a surface area of a cast product, at least partially coating each of the disposable patterns with a wet covering ceramic mold material, drying the wet coverings on the patterns, repeating the coating and drying steps until coverings of ceramic mold material of desired thicknesses have built up on the patterns, said step of coating the patterns includes at least partially covering a first pattern with material having a first rate of heat removal, said step of coating the patterns further includes at least partially covering a second pattern with a material having a second rate of heat removal, the second rate of heat removal being greater than the first rate of heat removal, separating the covering from the first pattern to at least partially form a first mold section, separating the covering from the second pattern to at least partially form a second mold section having a rate of heat removal which is greater than the rate of heat removal of the first mold section, and interconnecting the first and second mold sections to at least partially form a mold assembly having portions with different rates of heat removal.

6. A method as set forth in claim 5 wherein said steps of coating the first and second patterns includes repeating the coating and drying steps with one of the patterns a first number of times to build up a relatively thick covering of ceramic mold material on the one pattern and repeating the coating and drying steps with the other pattern a second number of times which is less than the first number of times to build up a relatively thin covering of ceramic mold material on the other pattern, said steps of separating the coverings of ceramic mold material from the first and second patterns at least partially resulting in the forming of relatively thick and thin walled mold sections.

7. A method as set forth in claim 5 wherein said step of coating the first pattern includes the step of dippping the first pattern in a body of liquid ceramic mold material having a first composition, said step of coating the second pattern includes the step of dipping the second pattern in a body of liquid ceramic mold material having a second composition.

8. A method as set forth in claim 5 wherein said steps of coating the first pattern includes the step of stuccoing a wet coating of ceramic mold material on the first pattern with a material having the first rate of heat removal, said steps of coating the second pattern includes the step of stuccoing a wet coating of ceramic mold material on the second pattern with a material having the second rate of heat removal.

* * * * *

UNITED STATES PATENT AND TRADEMARK OFFICE

CERTIFICATE OF CORRECTION

PATENT NO. : 4,170,256

DATED : October 9, 1979

INVENTOR(S) : William S. Blazek et al.

It is certified that error appears in the above-identified patent and that said Letters Patent are hereby corrected as shown below:

Column 16, line 53, change "dippping" to --dipping--.

Signed and Sealed this

*Eighteenth* Day of *March 1980*

[SEAL]

*Attest:*

SIDNEY A. DIAMOND

*Attesting Officer*

*Commissioner of Patents and Trademarks*